United States Patent [19]

Hard et al.

[11] 4,222,459

[45] Sep. 16, 1980

[54] PROTECTIVE SCAFFOLD

[75] Inventors: Thomas Hard, Ravena; Ronald Swingle, Troy, both of N.Y.

[73] Assignee: Atlantic Cement Company, Inc., Ravena, N.Y.

[21] Appl. No.: 14,713

[22] Filed: Feb. 23, 1979

[51] Int. Cl.[2] ..... E04G 1/34

[52] U.S. Cl. ..... 182/152; 182/128; 182/179

[58] Field of Search ..... 182/112, 152, 179, 128, 182/129, 178; 405/296, 288

[56] References Cited

U.S. PATENT DOCUMENTS

| | | | |
|---|---|---|---|
| 2,062,473 | 12/1936 | Norton | 182/152 |
| 2,556,611 | 6/1951 | Borgman | 182/179 |
| 3,128,842 | 4/1964 | Satrum | 182/152 |
| 3,566,991 | 3/1971 | Proulx | 182/129 |

FOREIGN PATENT DOCUMENTS

| | | | |
|---|---|---|---|
| 69272 | 5/1945 | Norway | 182/128 |
| 674037 | 6/1952 | United Kingdom | 182/179 |

*Primary Examiner*—Reinaldo P. Machado
*Attorney, Agent, or Firm*—Pennie & Edmonds

[57] ABSTRACT

A collapsible scaffold for overhead protection of workmen in cement kilns. The scaffold includes a plurality of scaffold units each of which is constructed for erection from a collapsed condition into an overhead protective position. The units are attached in series, one in front of the other, to provide protection along a designated length of work area.

10 Claims, 16 Drawing Figures

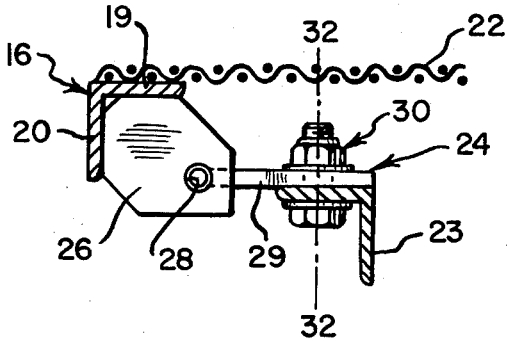
FIG. 4
FIG. 5
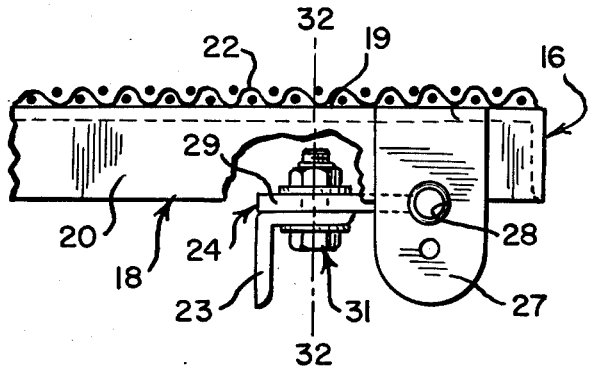
FIG. 7
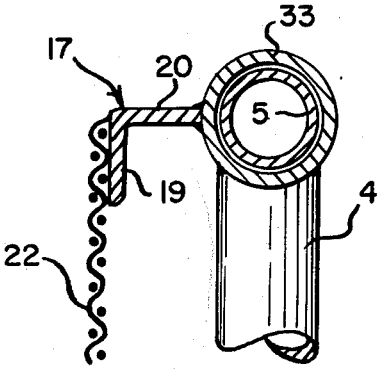
FIG. 8
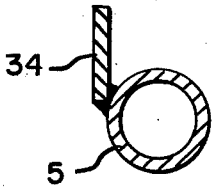
FIG. 9
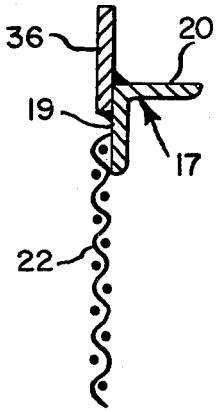

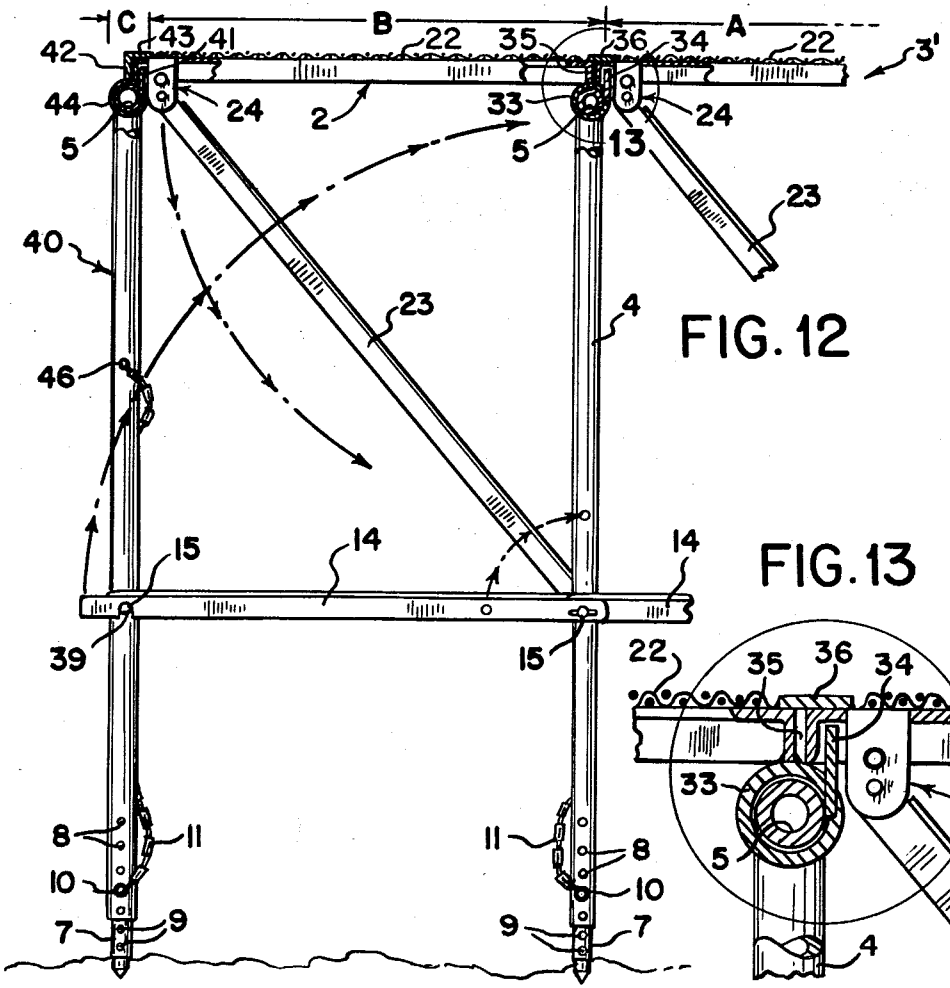
FIG. 12
FIG. 13
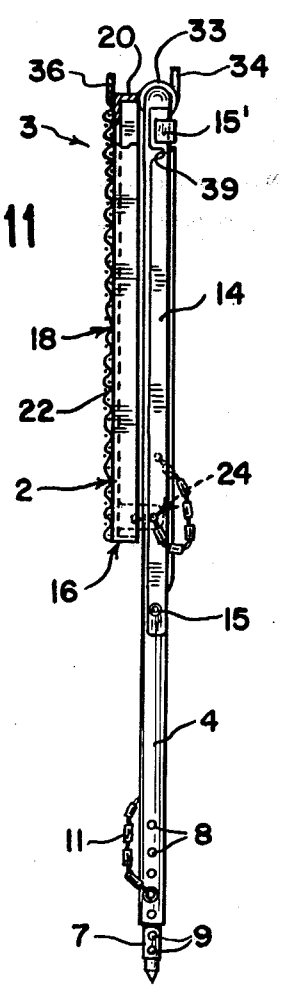
FIG. 11

PROTECTIVE SCAFFOLD

TECHNICAL FIELD

The present invention relates to a collapsible scaffold for the protection of workmen engaged in the cleaning of cement kilns.

BACKGROUND ART

Cement production involves the processing of raw materials in a kiln. The raw materials for a cement kiln are usually limestone and clays. Rotary kilns are commonly used for processing and consist of a horizontally disposed revolving, cylindrical tube internally lined with refractory material. The rotary kiln refractory lining typically is of a brick construction. The kiln itself is divided into a number of heat zones in which raw materials are processed by flame heating. The rotary kiln flames are maintained by the combustion of fuels such as liquid hydrocarbons, coal, and natural gas. The resulting product of kiln processing is cement clinker. A by-product of the cement rotary kiln process is the formation of kiln rings on the refractory lining.

The culmination of kiln rings is an unwanted build-up on the refractory lining which necessitates periodic shutdown of the kiln operation for clean-up and removal purposes. During clean-up, these rings present a danger to workmen and machinery used in their removal. Specifically, the kiln, being a horizontally disposed cylindrical tube, will have some of the kiln ring build-up disposed above the workmen who must enter the kiln during clean-up. There is a great danger that the overhead ring material when disturbed may fall upon those working in the internal kiln areas.

Protection from overhead falling materials has been previously disclosed in, for example, the Joseph patent, U.S. Pat. No. 3,115,754. The Joseph U.S. Pat. No. 3,115,754 relates to an apparatus for the purpose of supporting the roofs of underground excavations, such as the roofs of mineral mines and tunnels driven into ground strata. The purpose of the roof support is to give protection to workers and equipment against material which falls from the roof and sides of the excavation. The apparatus disclosed in the Joseph patent comprises a plurality of cage-type roof supporting, interconnected units having power means for independently elevating and lowering the units so as to conform to an undulating confinement. The Joseph apparatus also includes a collapsible structure for use in supporting overhead roofing during underground excavation.

DISCLOSURE OF THE INVENTION

In accordance with the teachings of the present invention, a collapsible scaffold is constructed from a plurality of scaffold units. The units are adapted to be positioned in series alignment, one in front of the other along the length of the interior area of the kiln in which workmen require protection. The scaffold is supported on the lower half of the cylindrical tube structure of the kiln and has an overhead protective framework under which the workmen can move and work.

Generally, each scaffold unit includes a main support frame which is vertically positioned and a protective cover frame which is pivotally secured to the main frame for movement into an overhead horizontal position. The cover frame of each unit is locked into its overhead position by the main support frame of the next unit which is erected in front of the previously erected unit. Interconnecting structure is provided on the main frame of each unit for attaching it to the cover frame of the next unit and for connecting together the main frames of adjacent units. The interconnecting structure rigidly secures one unit to the next in a stable fashion. A plurality of units can be connected in this way along the length of the kiln for which protection to the workers is needed.

The movable parts of each scaffold unit are all pivotally attached together to form a compact structure when collapsed. The collapsed units facilitate storage; and each subsequent new unit may be moved into place and erected while standing under the protection of the previously erected units.

BRIEF DESCRIPTION OF THE DRAWINGS

FIG. 4 is a cross-sectional view taken along lines 4—4 of FIG. 2;

FIG. 5 is a view taken along lines 5—5 of FIG. 2;

FIG. 7 is a cross-sectional view taken along lines 7—7 of FIG. 6;

FIG. 8 is a cross-sectional view taken along lines 8—8 of FIG. 6;

FIG. 9 is a cross-sectional view taken along lines 9—9 of FIG. 6;

FIG. 11 is a side view of the scaffold unit;

FIG. 12 is a side elevation of an erected scaffold unit interconnected both to an adjacent rearwardly disposed unit and a forwardly disposed terminating support;

FIG. 13 is an enlarged view of the encircled area shown in FIG. 12;

BEST MODE FOR CARRYING OUT THE INVENTION

Figure 6:
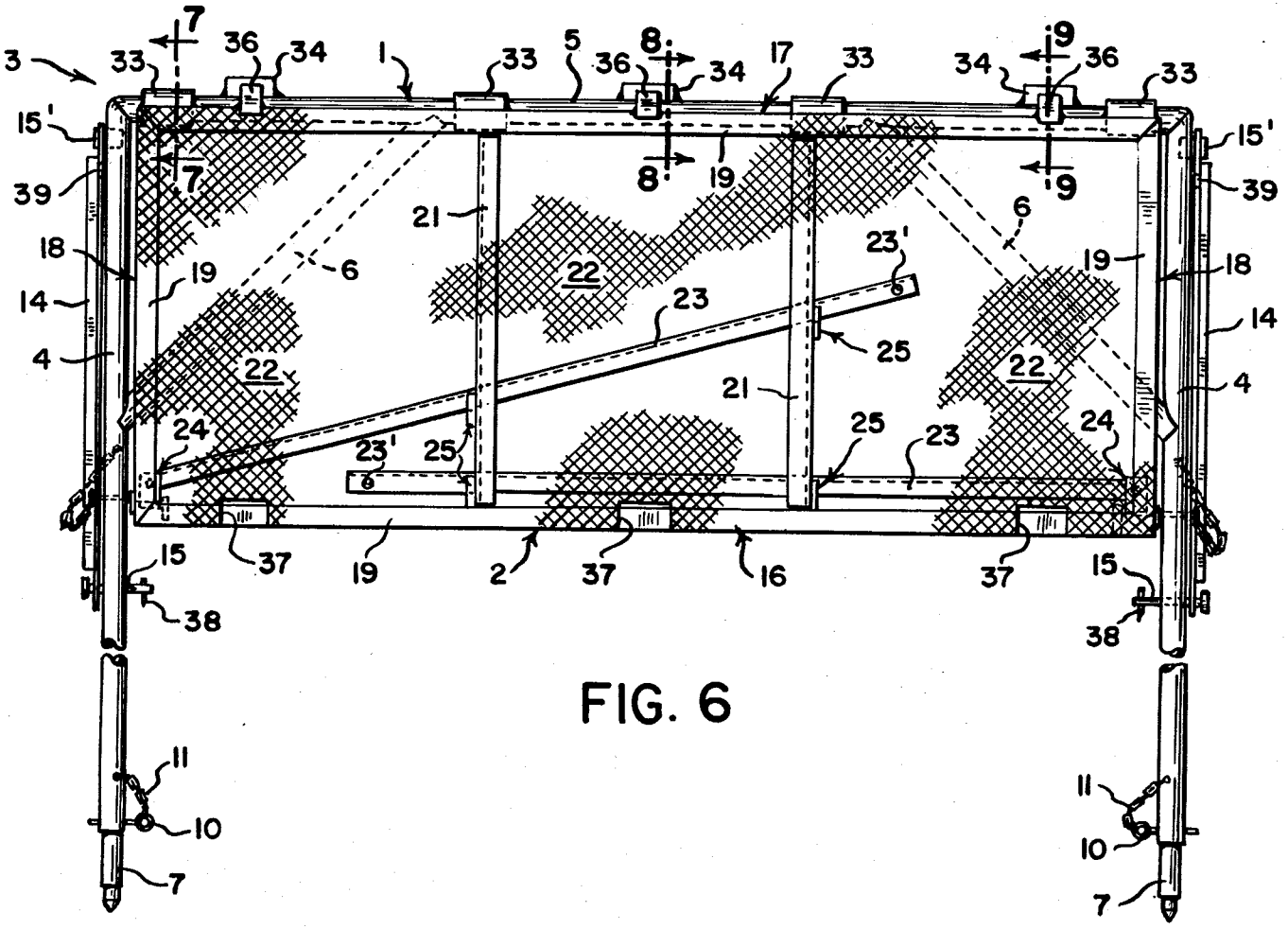
FIG. 6 is a front elevation of a complete scaffold unit.
Figure 10:
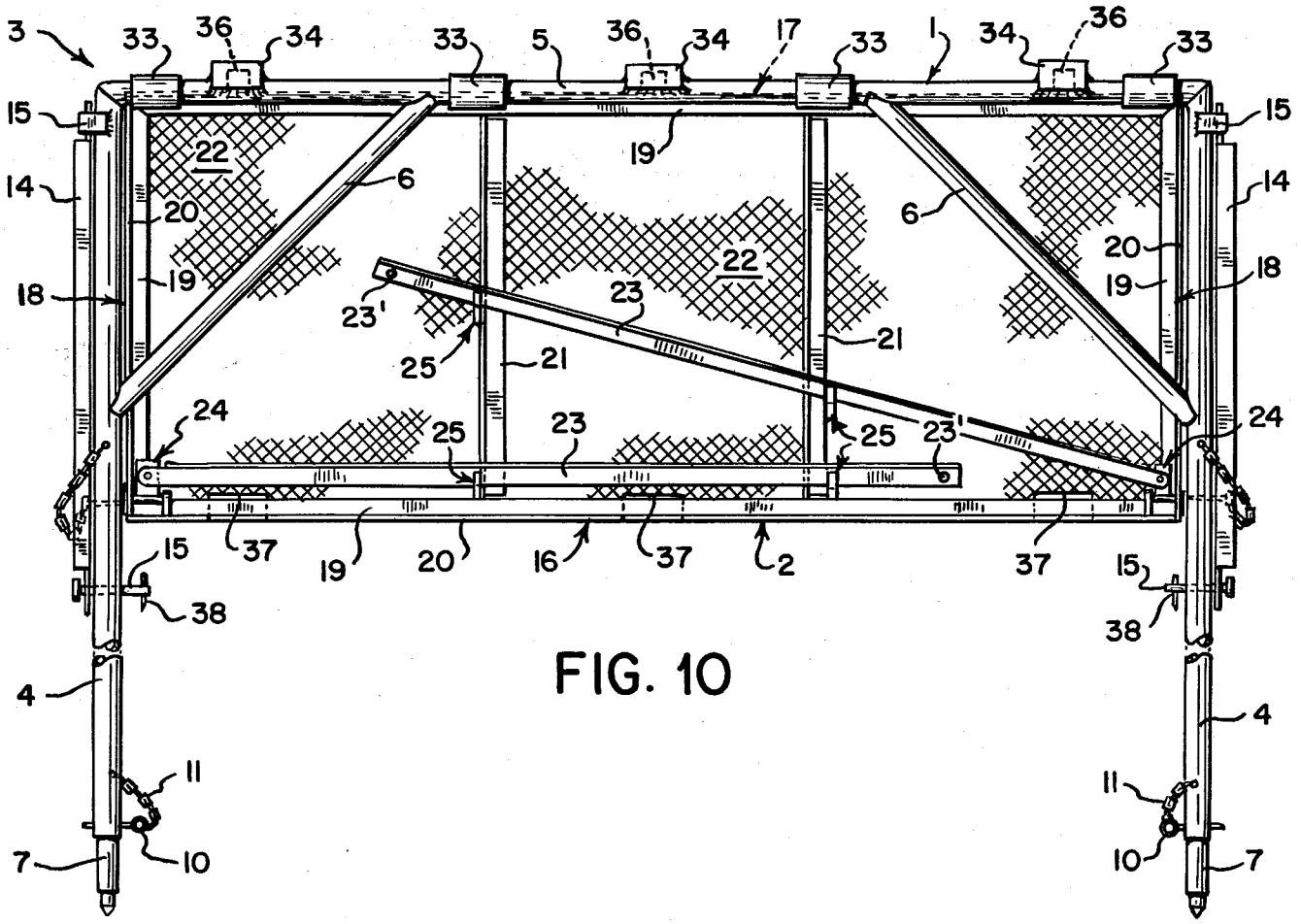
FIG. 10 is a rear elevation of a complete scaffold unit.

Each scaffold unit is comprised of two basic members. The first is the main support frame 1, shown in FIG. 1, and the second is the protective cover frame 2, shown in FIG. 2. The assembled scaffold unit, designated generally by reference numeral 3, is shown in FIGS. 6, 10 and 11.

Figure 1:
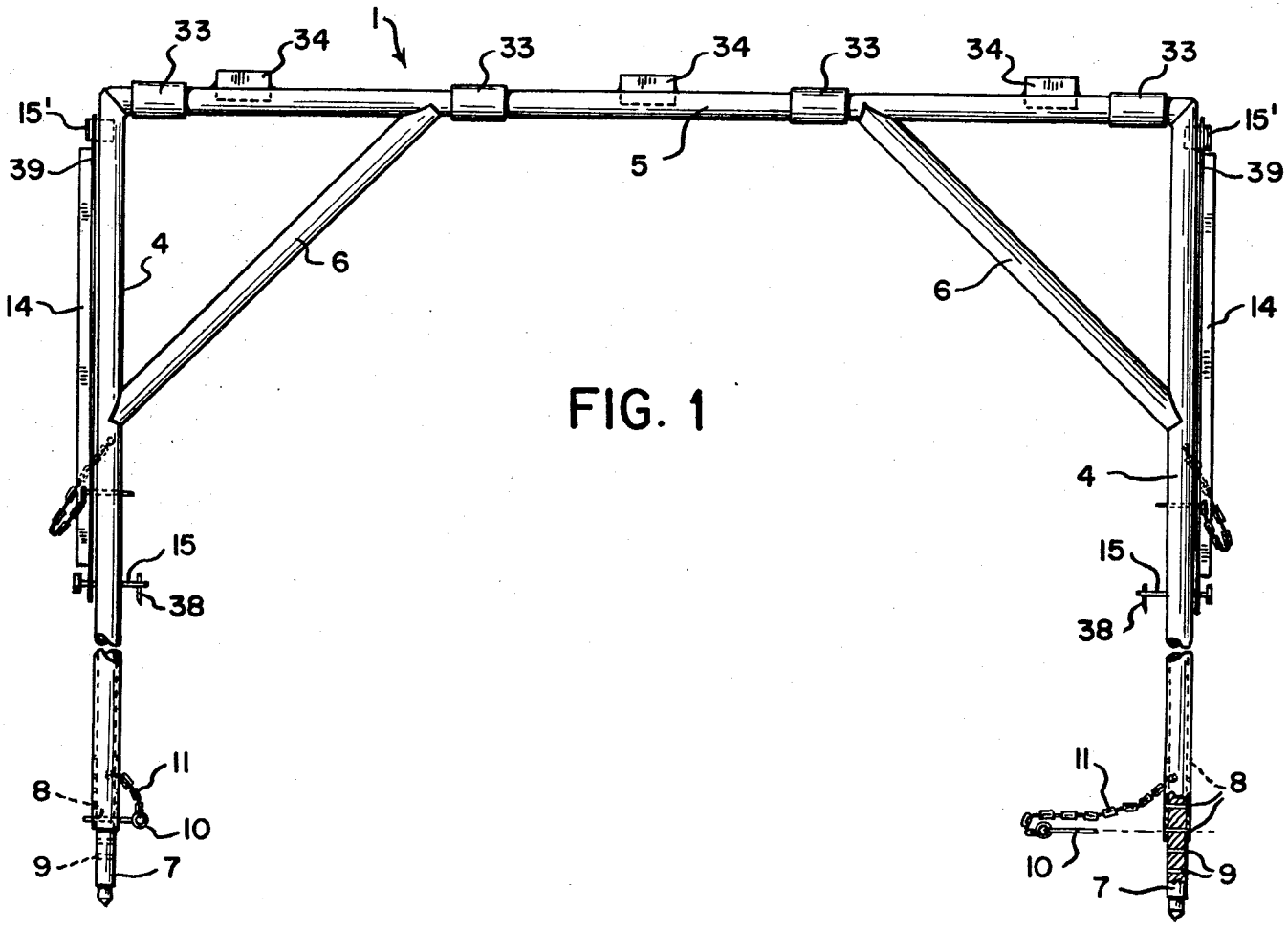
FIG. 1 is a front elevation of the vertical main support frame of the scaffold unit.
Figure 15:
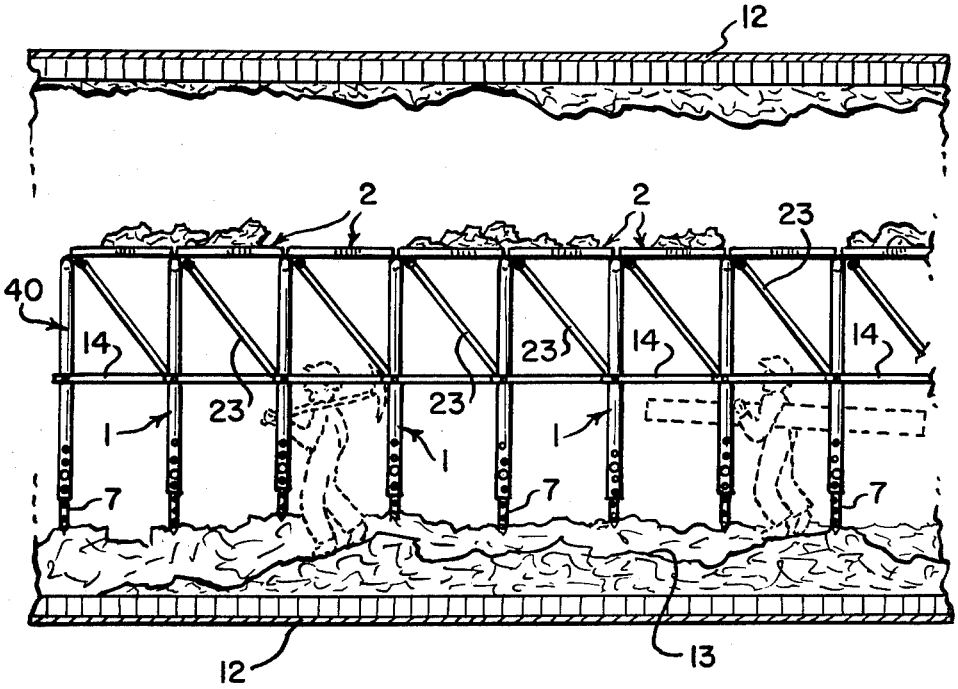
FIG. 15 is a side elevation of a series of erected scaffold units within a rotary kiln.
Figure 16:
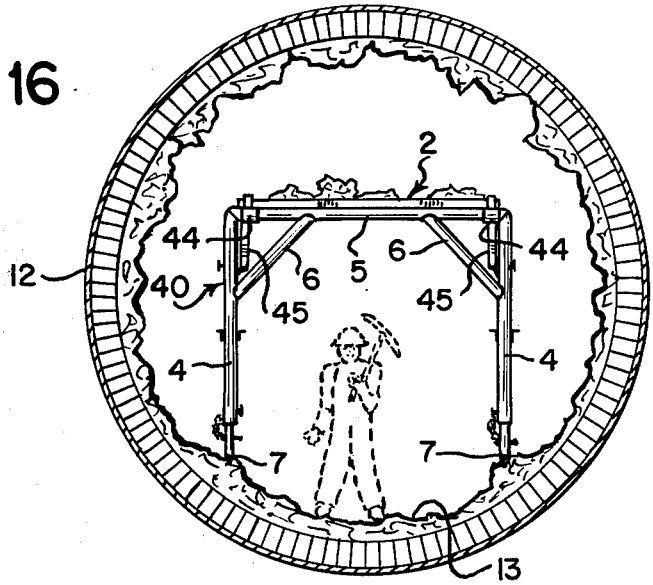
FIG. 16 is an end view of the kiln interior shown in FIG. 15.

The main support frame of the scaffold unit, as shown in FIG. 1, is constructed of tubular members and includes two spaced vertical legs 4 and a crossbar 5 connecting the legs together at their upper ends. Diagonal reinforcing bars 6 are welded to the legs and crossbar. The legs of the main support frame include extensible members 7 which are telescoped into the legs at their lower ends. A series of spaced holes 8 are provided at the lower ends of the legs for cooperation with a complementary series of holes 9 in the extension member. A securing pin 10 is attached to each leg by suitable means such as a chain 11 for insertion through any pair of aligned holes 8 and 9 to hold the extension members in their adjusted positions. By this means the height of the main support frame can be varied to suit the conditions in which it is used and to assure that the height of all the units which are erected on the uneven terrain existing in the interior of the kiln will have the same overall height. FIGS. 15 and 16 depict a series of such scaffold units connected together in the interior of a kiln 12 with the legs of each adjusted to accommodate the uneven terrain 13 on which the units are supported.

As shown in FIG. 1, each main support frame further includes a pair of rotating angle iron arm members 14, each of which is pivotally attached to one of the legs 4 of the main support frame. A pivot and support rod structure 15 is provided for this purpose. The arm members 14 are held in a collapsed condition closely adjacent the legs 4 by means of stop members 15'. These stop members are attached at the upper ends of the legs for receiving the free ends of the arm members.

Figure 2:
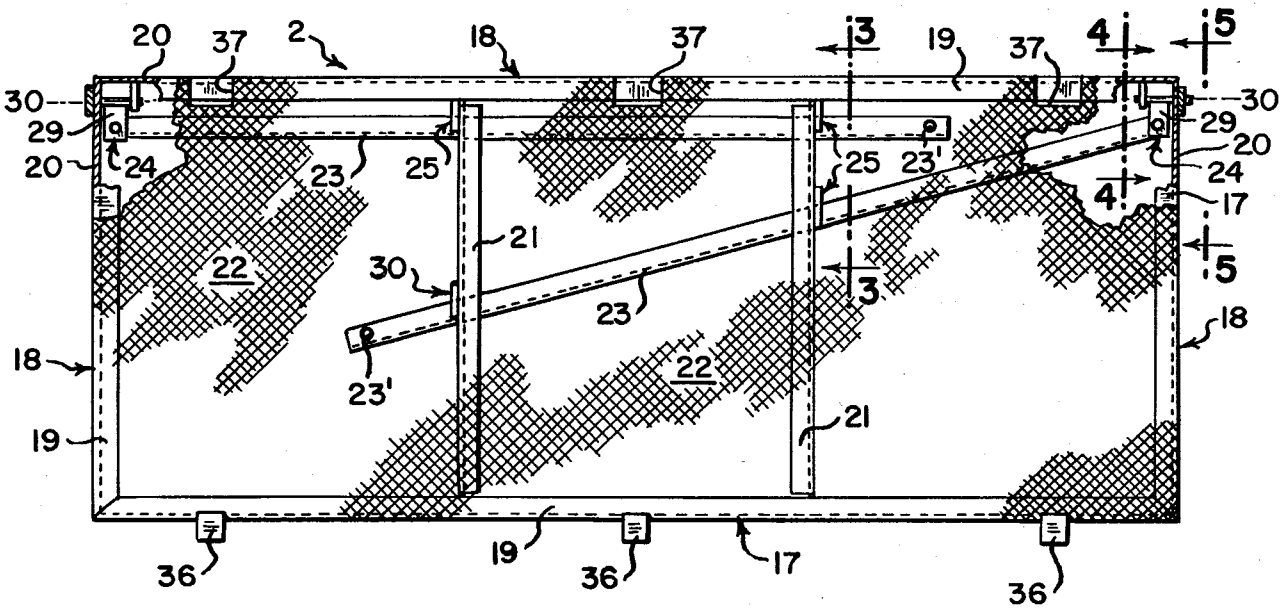
FIG. 2 is a top plan view of the protective cover frame of the scaffold unit.

The protective cover frame 2 of the scaffold unit is, as shown in FIG. 2, rectangular in shape and constructed of front and rear members 16, 17 and side members 18 connected to the front and rear members at their ends. The members making up the cover frame are L-shaped angle irons with one leg 19 of each angle iron lying in a single top plane to define a top support surface for the cover frame. The other leg 20 of each L-shaped iron extends downwardly at the periphery of the cover frame. Cross support members 21, also of angle iron construction, connect the front and rear members together intermediate their ends to provide additional rigidity and top support surface for the frame. A protective cover 22 in the form of a wire screen is supported on the top support surface of the legs 19 of the front, rear and side members and the corresponding legs of the cross members 21.

A pair of diagonal support members 23 of angle iron construction are secured at the front corners of the cover frame where the front member 16 is joined by the side members 18. Each diagonal support member is secured to the frame by a pivot connector 24 for universal movement from a first position lying in the plane of the cover frame as shown in FIG. 2 to a second position extending diagonally downwardly toward the adjacent vertical leg of the main support frame as shown in FIG. 12.

Figure 3:
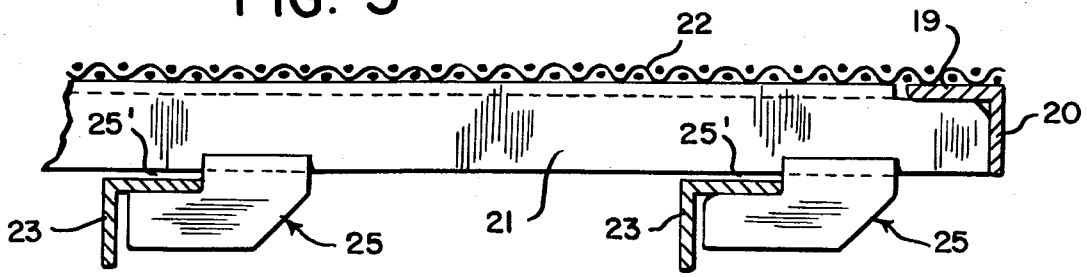
FIG. 3 is a view taken along lines 3—3 of FIG. 2.

The two diagonal support members are held in their collapsed position within the plane of the cover frame by means of holding plates 25 attached to the downwardly depending legs of the cross members 21. As shown in FIG. 3, each holding plate includes a tongue portion spaced from the lower edge of the depending leg of the cross member to provide a slot 25' into which the aligned leg of the diagonal support member is received for storage.

The pivot connector for the diagonal support members is best shown in FIGS. 4 and 5 and comprises a pair of support brackets 26, 27 welded respectively to the front and side members of the cover frame. These two brackets are provided with aligned holes 28 into which a plate 29 is pivotally secured. With this construction the plate 29 will pivot about the axis 30 (FIG. 2) defined by the aligned holes 27. The diagonal support member is, in turn, pivotally attached to the plate 29 by suitable means such as the nut and bolt assembly 31 for pivoting movement about the axis 32 (FIGS. 4 and 5) extending perpendicular to the axis 30. This double pivot connection of the diagonal support member permits universal movement.

FIGS. 6–10 best show the connection of the cover frame to the main support member. For this purpose, a plurality of hinged means 33 in the form of sleeve members are rotatably mounted in spaced relation on the crossbar 5 of the main support frame. Each of these sleeve members is welded or otherwise attached to the depending leg 20 of the rear angle iron member 17 of the cover frame (see FIGS. 6 and 7). This pivot connection permits movement of the cover frame from the collapsed position shown in FIG. 11 to the erected position shown in FIG. 12.

In addition to the sleeves 33, the crossbar 5 of the main support frame of each unit includes a plurality of locking flanges 34 in the form of flat plates welded or otherwise connected to the crossbar so as to extend tangentially upwardly thereof. These plates are best shown in FIGS. 6, 8 and 10. They are positioned on the crossbar intermediate the pivot sleeves 33. When the cover frame is moved to the erected position shown in FIG. 12, the flat plates 34 will be oriented along the back side of the crossbar 5 diametrically opposite the location of the erected cover frame 2. As shown in the enlarged view of FIG. 13, the plates 34 together with the downwardly depending leg 20 of the rear member of the cover frame, will define a longitudinal channel 35. This channel will receive the downwardly directed leg 20 of the front member 16 of the cover frame of the previously erected unit designated 3' in FIG. 12.

The cover frame of each unit also includes a plurality of hold-down flanges 36 in the form of flat plates and attached to the rear member 17 of the cover frame (see FIGS. 6 and 9). These plates are positioned at spaced intervals along the top leg 19 of the rear member and extend rearwardly of the cover frame. When the cover frame is moved to its erected position as shown in FIG. 12 these hold-down flanges 36 will rotate to a position overlying the front member of the cover frame of the previously erected unit 3' to hold this unit against raising. The wire screen 22 of the cover frame is provided with suitable cutout sections 37 as shown in FIGS. 2 and 6 for receiving the hold-down flanges 36.

Reference is now made to FIG. 12 for a description of the erection of a single scaffold unit and the attachment thereof, in series alignment, in front of a previously erected unit. In FIG. 12, the previously erected unit 3' is shown at location A; the unit being erected, and to which the following description mainly pertains, is shown at location B, to the left of location A; and a terminating support, to be later described, is shown at location C.

In erecting the scaffold unit, it is first moved into position under forward end of the last erected unit. Preferably, this movement is through the previously erected units so as to protect the workers. The collapsed unit is then turned into a position with the main frame extending vertically; and the upwardly projecting locking flanges 34 of the unit are engaged directly behind the depending leg 20 of the front frame member of the previously erected unit. The cover frame of the unit being erected is then swung into an overhead horizontal position. The depending leg 20 of the rear member of the cover frame together with the locking flanges 34 thus forms the previously mentioned channel 35 to lock the front member of the previously erected cover frame from moving either rearwardly or forwardly. At the same time, the hold-down flanges 36 of the unit will move into hold-down position over the cover frame of the previously erected unit.

As the cover frame of the unit is being swung upwardly, the diagonal support members 23 are pivoted about the universal pivot connectors 24 and diagonally downwardly toward the adjacent vertical legs of the main support frame. These diagonal support members are each provided at their ends with an attaching means, in the form of a hole 23', which are positioned in alignment with the pivot and support rod 15 and locked in place by a suitable pin 38. Since the diagonal support members are located inwardly of the vertical legs, they will be attached to the portion of the associated rod 15 extending inwardly of the main support frame.

The arm members 14, attached to the vertical legs of the previously erected unit, are then swung downwardly to a horizontal position. The ends of these arms are provided with attaching slots 39 which will engage on the support rod 15 of the unit just erected to maintain the vertical legs of both units in parallel vertical relationship with each other. These arms 14 are disposed outwardly of the legs of the main frame support and thus do not interfere with the attachment of the diagonal support members disposed inwardly of the legs.

Figure 14:
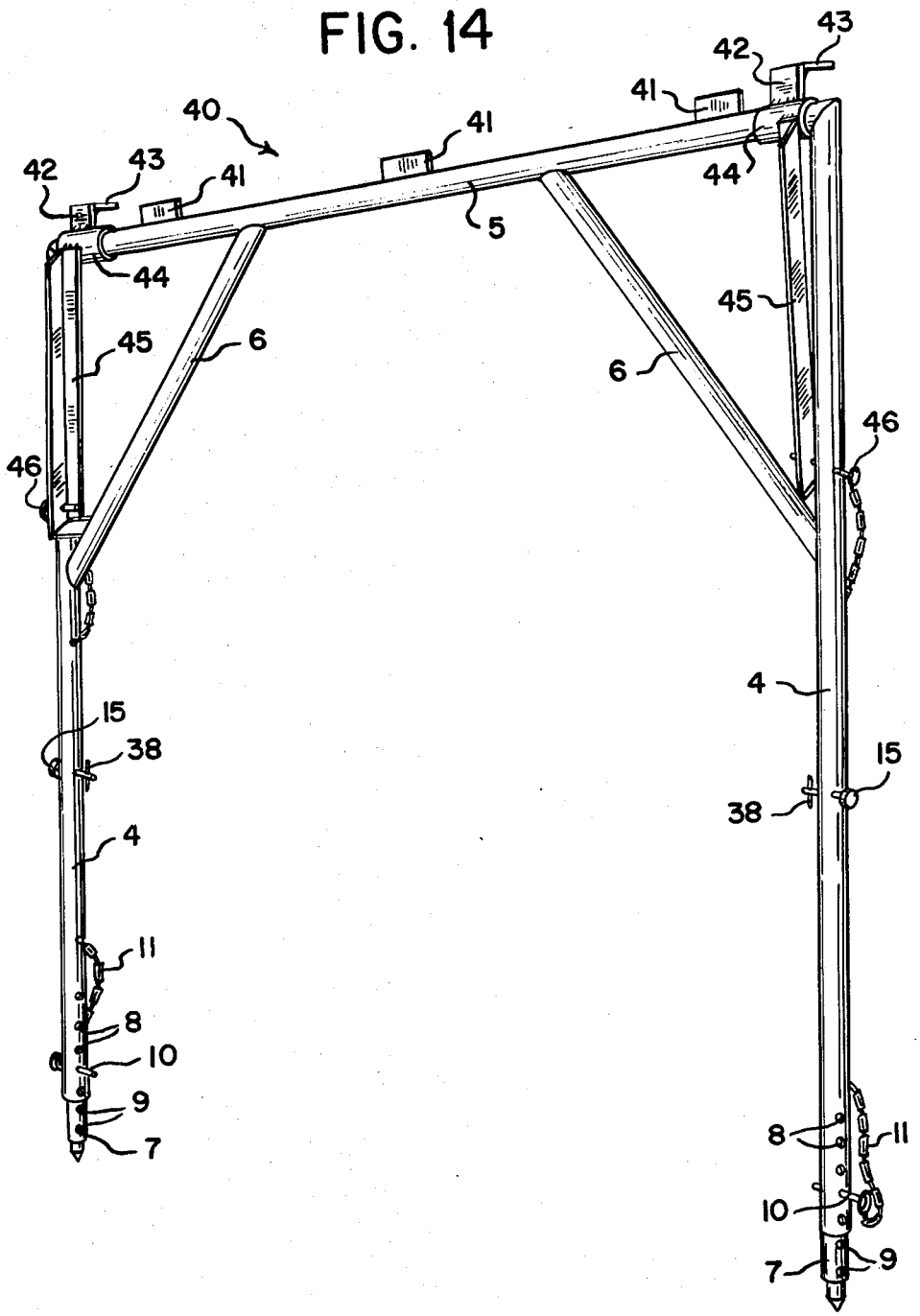
FIG. 14 is a perspective view of the terminating support for the last erected scaffold unit.

The connection of additional units in series alignment, one in front of the other and to the left as shown in FIG. 12, is continued until the desired length of scaffold is provided. When this length has been reached, a terminating support 40, shown in FIG. 14, is placed under the front member of the last erected cover frame. Such a terminating support is shown to the left of FIG. 12 at location C. Like the main support frame of the individual scaffold units, this terminating support includes a main frame having upstanding fixed locking flanges 41 welded tangentially to the crossbar 5 of the frame. Cooperating with these flanges are a second set of pivoting and hold-down flanges 42, 43 pivotally secured to the crossbar through rotating sleeve members 44.

In construction, the pivoting flange 42 is welded to the sleeve member 44 in the same way as the downwardly depending leg 20 of the front member of the cover frame is welded to the sleeve members 33 in each scaffold unit. The hold-down flanges 43 are, in turn, welded to the upper ends of the pivoting flanges 42 and extend rearwardly of the terminating support to overlie the front member of the last erected cover frame and prevent it from raising.

To control pivoting movement of the pivoting and hold-down flanges, a control bar 45 is connected to the sleeve 44. By movement of this control bar, both flanges 42 and 43 may be moved from a first upstanding position aligned with the fixed locking flanges 41 and overlying front member of the cover frame of the last erected unit to a second withdrawn position. This withdrawn position removes the flanges 42 and 43 from interfering with initial proper positioning of the fixed flanges 41 behind the front member of the last erected cover frame. After the fixed flanges are in position, the control bar is rotated to move the flanges 42 and 43 into operative position. Locking means in the form of a pin 46 secure the control arm to the adjacent leg when the flanges 42 and 43 are in their operative position. After erection of the terminating support, the construction of the scaffold is then completed by rotating the horizontal arms 14 of the last erected scaffold unit downwardly to the horizontal position. The slots 39 formed in the ends of the arms are then engaged on the associated support rods 15 projecting from the legs of the terminating support frame.

We claim:

1. An overhead protective scaffold constructed from a plurality of scaffold units adapted to be positioned in series alignment, one in front of the other, with each unit comprising:

(a) a vertical main support frame having laterally spaced vertical legs and a crossbar connecting the legs at their upper ends;

(b) a protective rectangular cover frame having front, rear and side edges;

(c) hinge means pivotally connecting the rear edge of the cover frame to the crossbar of the main support frame for pivoting movement about the longitudinal axis of the crossbar from a storage position lying adjacent the plane of the main support frame to an erected overhead protective position extending horizontally when the main support frame is in a vertical position;

(d) first interconnecting means mounted on said crossbar for connecting the crossbar of the unit to the front edge of the cover frame of a previously erected unit; and (e) a second interconnecting means attached to each of the legs of the unit for connection with the serially aligned legs of the next adjacent unit to maintain said legs of the units in fixed vertical position relative to each other.

2. A scaffold according to claim 1 further comprising:

(a) a pair of diagonal support members connected at one end to the cover frame adjacent the front edge thereof;

(b) means for securing the other ends of the diagonal support members to the adjacent vertical legs of the main support frame when the cover frame has been swung about its pivot to an erected position to hold the cover member in said erected position; and (c) pivot connector for pivotally connecting the one end of a diagonal support member to the cover frame at each intersection of the front edge with one of the side edges of the frame member for universal movement from a first position lying in the plane of the cover frame to a second position extending diagonally downwardly toward the adjacent vertical leg of the main support frame when the cover frame has been swung about its pivot to a horizontal overhead protective position.

3. An overhead protective scaffold constructed from a plurality of scaffold units adapted to be positioned in series alignment, one in front of the other, with each unit comprising:

(a) a vertical main support frame having laterally spaced vertical legs and a crossbar connecting the legs at their upper ends;

(b) a protective rectangular cover frame having spaced front and rear members and side members interconnecting the front and rear members at the ends thereof;

(c) hinge means pivotally connecting the rear member of the cover frame to the crossbar of the main support frame for pivoting movement about the longitudinal axis of the crossbar from a storage position lying adjacent the plane of the main support frame to an erected overhead protective position extending horizontally when the main support frame is in a vertical position;

(d) first interconnecting means mounted on said crossbar for connecting the crossbar of the unit to the front member of the cover frame of a previously erected unit when the unit is positioned in front of the previously erected unit with the cover frames of both units in their erected positions, said first interconnecting means being defined by:

(1) at least one upstanding locking flange secured to said crossbar for positioning directly behind the front member of the cover frame of the previously erected unit, and (2) the rear member of the cover frame of the unit which when erected is positioned directly ahead of the front member of the cover frame of the previously erected unit; and (e) a pair of second interconnecting means, each having one end pivotally connected to one of the vertical legs of the main support frame and attaching means at the other end for attachment to the forwardly aligned vertical leg of the next forwardly adjacent unit to maintain said legs in fixed vertical position relative to each other.

4. A scaffold according to claim 3 further comprising:

(a) hold-down flange means attached to the top of the rear member of the cover frame and extending rearwardly thereof for positioning over the front member of the cover frame of the previously erected unit to prevent raising thereof.

5. A scaffold according to claim 4 wherein:

(a) the main support frame is constructed of tubular members;

(b) the cover frame is constructed of:

(1) L-shaped angle irons with one leg of each lying horizontally to define a top support surface and the other leg extending downwardly at the periphery of the frame, and (2) a protective cover attached to the top support surface defined by the angle irons;

(c) the hinge means includes a plurality of sleeve members rotatably mounted in spaced relation on the crossbar of the main support frame and connected along their exterior surface to the downwardly extending leg of the angle iron forming the rear member of the cover frame; and (d) the locking flange of the first interconnecting means includes a plurality of flat plates connected at spaced intervals to the crossbar and extending tangentially thereof on the side diametrically opposite the cover frame when in its erected position to define a longitudinal channel therebetween for receiving the downwardly directed leg of the front member of the cover frame of the previously erected unit.

6. A scaffold according to claim 5 wherein:

(a) the hold-down flange means comprises a plurality of flat plates attached at spaced intervals along the top of the rear member of the cover frame.

7. A scaffold according to claim 6 further comprising:

(a) a diagonal support member connected at one end to the cover frame at the intersection of the front member with each side member;

(b) means for securing the other ends of the diagonal support members to the adjacent vertical legs of the main support frame when the cover frame has been swung about its pivot to its erected position; and (c) pivot connector for pivotally connecting the one end of each of the diagonal support members to the cover frame for universal movement from a first position lying in the plane of the cover frame and extending toward the opposite side member thereof to a second position extending diagonally downwardly toward the adjacent vertical leg of the main support frame when the cover frame has been swung about its pivot to its erected position.

8. A scaffold according to claim 7 further comprising:

(a) a terminating end support for attachment to the front member of the erected cover frame of the last unit in the series, said terminating end support including:

(1) a vertical main support frame having laterally spaced vertical legs and a crossbar connecting the legs at their upper ends, (2) at least one upstanding fixed locking flange secured to said crossbar for positioning directly behind the front member of the cover frame of the last erected unit, (3) a hold-down flange pivotally secured to said crossbar for pivoting movement between a first hold-down position over the front member of the cover frame of the last erected unit to prevent raising thereof and a second withdrawn position, and (4) locking means for locking the hold-down flange in said hold-down position.

9. A scaffold according to claim 8 further comprising:

(a) an upstanding pivoting flange secured to said crossbar for pivoting movement between a first upstanding position aligned with the locking flange to provide a channel therebetween for receipt of the front member of the cover frame of the last erected unit and a second withdrawn position out of cooperating alignment with said locking flange.

10. A scaffold according to claim 9 wherein:

(a) the hold-down flange is attached to the upper end of the upstanding pivoting flange; and (b) the locking means includes:

(1) a control arm pivotally mounted on said crossbar and connected to said upstanding pivoting flange, and (2) means for attaching the control arm to a leg of the main support frame of the terminating end support when the pivoting and hold-down flanges are in their first position.

* * * * *